US008016220B2

(12) United States Patent
Melo et al.

(10) Patent No.: US 8,016,220 B2
(45) Date of Patent: Sep. 13, 2011

(54) MILL LINER ASSEMBLY

(75) Inventors: Ricardo Abarca Melo, Santiago (CL); Ricardo Fernandez Daberti, Santiago (CL)

(73) Assignee: Vulco, S.A. (CL)

( * ) Notice: Subject to any disclaimer, the term of this patent is extended or adjusted under 35 U.S.C. 154(b) by 0 days.

(21) Appl. No.: 11/795,654

(22) PCT Filed: Jan. 16, 2006

(86) PCT No.: PCT/AU2006/000049
§ 371 (c)(1),
(2), (4) Date: Feb. 27, 2008

(87) PCT Pub. No.: WO2006/076764
PCT Pub. Date: Jul. 27, 2006

(65) Prior Publication Data

US 2008/0265074 A1 Oct. 30, 2008

(30) Foreign Application Priority Data

Jan. 18, 2005 (CL) ..... 0102-2005

(51) Int. Cl.
*B02C 17/22* (2006.01)

(52) U.S. Cl. ..... 241/183

(58) Field of Classification Search ..... 241/182, 241/183, 299, DIG. 30
See application file for complete search history.

(56) References Cited

U.S. PATENT DOCUMENTS

| | | | | | |
|---|---|---|---|---|---|
| 3,107,867 | A | * | 10/1963 | Svensson et al. | 241/102 |
| 3,607,606 | A | * | 9/1971 | Beninga | 428/67 |
| 3,942,239 | A | * | 3/1976 | Johansson | 29/462 |
| 4,177,955 | A | * | 12/1979 | Miller | 241/183 |
| 5,472,148 | A | * | 12/1995 | Schaeffer | 241/183 |
| 6,510,729 | B2 | * | 1/2003 | Bonnevie et al. | 73/86 |

FOREIGN PATENT DOCUMENTS

| | | |
|---|---|---|
| SU | 950 436 | 8/1982 |
| SU | 1235 527 A1 | 6/1986 |

* cited by examiner

*Primary Examiner* — Faye Francis
(74) *Attorney, Agent, or Firm* — Morriss O'Bryant Compagni

(57) ABSTRACT

A liner assembly for use in a grinding mill, the liner assembly including a liner body including a mounting member, and an elastomeric cushioning member operatively connected to the mounting member. The cushioning member includes a plurality of support cavities therein, and a plurality of wear elements mounted within the support cavities.

14 Claims, 5 Drawing Sheets

MILL LINER ASSEMBLY

BACKGROUND OF THE INVENTION

1. Field of the Invention

The present invention relates generally to the crushing, grinding, comminuting or similarly processing materials such as mineral ores, rock and other materials, and more particularly to apparatus for use in such processing. In one example application sulphurated minerals are processed to produce particulated matter of a size between 100 and 20 microns.

2. Description of Related Art

Grinding mills are one form of apparatus used for processing materials as described above. Typical grinding mills generally comprise a drum shaped shell mounted for rotation about its central axis. The axis of the shell is generally horizontally disposed or slightly inclined towards one end. The interior of the shell forms a treatment chamber into which the material to be processed is fed. In one form of mill known as a SAG (semi autogenous grinder) a grinding medium such as balls or rods is fed to the treatment chamber with the material to be processed. During rotation of the shell the grinding medium acts on the material to cause the crushing or grinding action. In conventional mills and SAG mills the aspect ratio of the mill diameter to the mill length is $\leqq 1$ and $>1$ respectively. The grinding medium and material to be processed are carried up the side of the shell as a result of the centrifugal force created by rotation of the shell whereafter it falls towards the bottom of the shell under the influence of gravity. To assist in lifting the material up the side of the shell, lifter bars are often provided which are secured to the interior surface of the shell. The lifter bars extend generally longitudinally of the shell and are circumferentially spaced apart around the inner surface. The higher the material travels up the shell the better the grinding of the material. Examples of such mils are described in Chilean Patents 39450 and 36411.

FIG. 1 is a partial schematic illustration of a typical grinding mill having a shell 10 with a plurality of lifter bars 12 mounted to the inner surface of the shell 10. The lifter bars 12 are circumferentially spaced apart around the inner surface of the shell 10 and extend in the direction of the axis of rotation of the shell. The spaces between adjacent lifter bars 12 form channels 14 of width J. The length of the bars 12 is shown as LM which is the inner length of the shell in the direction of rotation thereof. Preferably the number of channels 14 is the same as the number of lifter bars 12.

FIGS. 2 to 4 are various illustrations of conventional liner assemblies adapted to be installed in a mill as shown in FIG. 1.

As shown in FIG. 2, each channel 14 is adapted to have mounted therein a liner assembly 20. The conventional liner assembly 20 includes a metal base member 22 which is adapted to be mounted to the inner surface of the shell by suitable fastenings such as bolts (not shown). The base member 22 includes an elongated plate having mounting elements 23 thereon. The liner assembly further includes a generally flat wear element 24 which is mounted to the base member 22. The wear element 24 may be formed of an elastomeric material or metal for providing protection against abrasion and impact. Because of the constant impact forces applied to the wear elements when the mill is in operation, they will tend to break after a period of time. When breakage occurs the mill needs to be stopped while they are replaced. This can be time consuming and reduce the overall productivity of the mill.

It is an object of the present invention to provide an improved mill liner assembly which alleviates the aforementioned problem.

BRIEF SUMMARY OF THE INVENTION

According to one aspect of the present invention there is provided a liner assembly for use in a grinding mill, the liner assembly including a liner body including a mounting member, an elastomeric cushioning member operatively connected to the mounting member, said cushioning member including a plurality of support cavities therein, and a plurality of wear elements mounted within the support cavities.

The liner assembly according to the present invention is suitable for a use which includes a rotatable shell having a plurality of lifter bars on the inner surface thereof, the lifter bars extending generally in the same direction as the axis of rotation of the shell. The lifter bars are circumferentially spaced apart around the inner surface of the shell so as to form channels therebetween. Preferably the liner assemblies are disposed within the channels with the mounting members secured to the inner surface of the shell.

In one form, the cushioning member may be an elongated body having the cavities arranged in a row extending in the longitudinal direction of the elongated body. Two or more rows of cavities may be arranged side by side. In one form, the cavities in one row may be offset with respect to cavities in an adjacent row. The length of the cushioning member may be between 2 to 12 times the width of the member.

In one form, the liner body may include a base wall, opposed side walls extending away from the base wall and terminating at an outer edge, and an outer wall extending from the outer edge of the side walls. The distance K from the base wall to the outer edge of the side walls may be about the width of the lifting bar. The distance M from the outer edge of the side walls to an outermost region of the outer wall may be about 1 to 40 cm.

The cavities may include a lower wall and the distance S from the base wall of the liner body to the lower wall of the cavities may be from 0.1 K to 0.9 K where K is the distance from the base wall to the outer edge of the side walls of the liner body.

The elastomeric cushion may have a Shore hardness between 30 to 85 hardness Shore A.

Adjacent cavities in a row may be separated by a wall having a thickness from about 0.5 mm to 20 mm. The wear elements may be generally polyhedric in shape. The wear elements may have a Brinell hardness of between 350 to 800 BHN. Preferably the outer surface of the outer wall of the liner body is substantially defined by an outer surface of the wear elements.

The side walls of the body may be slightly inclined towards one another.

Preferred embodiments of the invention will hereinafter be described with reference to the accompanying drawings.

DETAILED DESCRIPTION OF THE INVENTION

Figure 1:
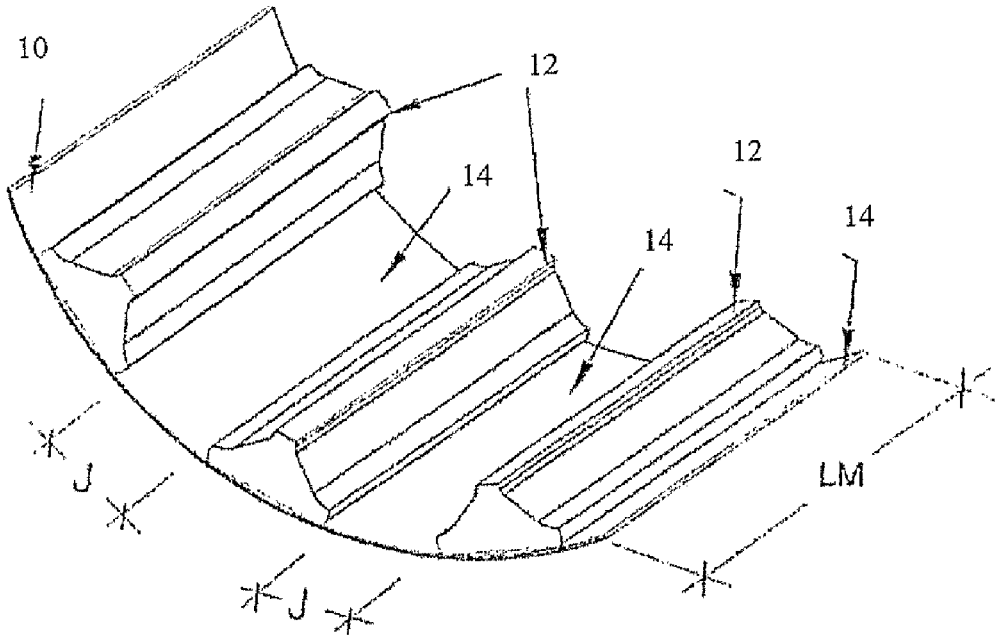
FIG. 1 (PRIOR ART)
FIG. 1 is a partial cross-section of an axonometric view of a mill without protective liners.
Figure 2:
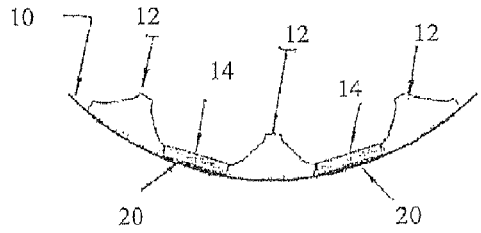
FIG. 2 (PRIOR ART)
FIG. 2 is a partial view of an elevated cross-section perpendicular to the axis of the mill with conventional protective liner assemblies.
Figure 3:
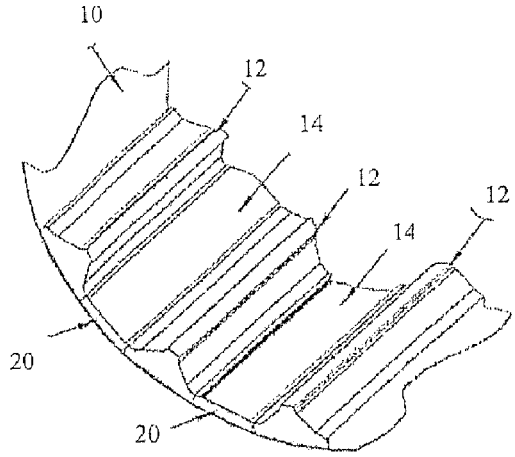
FIG. 3 (PRIOR ART)
FIG. 3 is a partial cross-section of an axonometric view of a mill with conventional protective liner assemblies.
Figure 4:
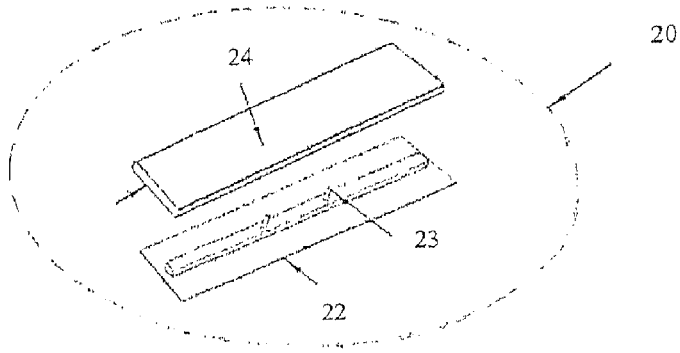
FIG. 4 (PRIOR ART)
FIG. 4 illustrates the features of a conventional protective liner assembly.

A partial view of a typical grinding mill is shown in FIG. 1 having conventional liner assemblies has as been described earlier with reference to FIGS. 2 to 4.

Figure 5:
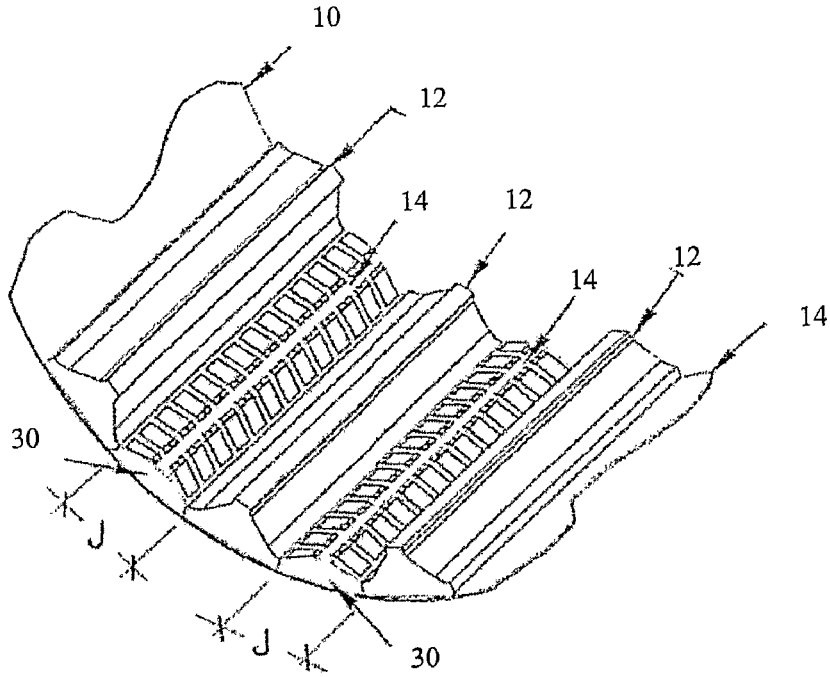
FIG. 5 is a partial cross-section of an axonometric view of a mill with protective liner assemblies according to the present invention.
Figure 6:
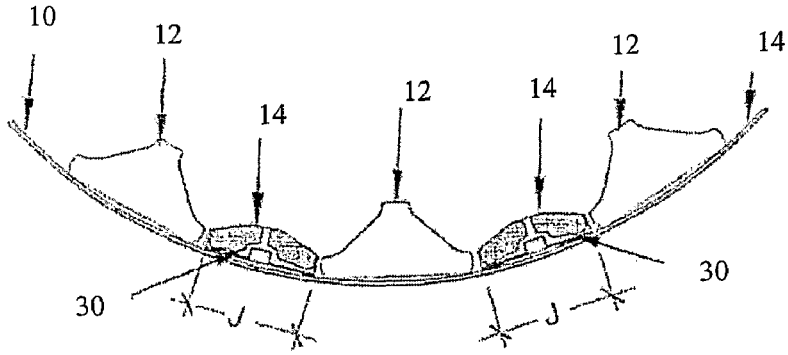
FIG. 6 is a partial view of an elevated cross-section perpendicular to the axis of the mill with liner assemblies according to the present invention.

FIG. 5 is a partial schematic illustration of a grinding mill with liner assemblies according to the present invention. The mill has a shell 10 with a plurality of lifter bars 12 mounted to the inner surface of the shell 10. The lifter bars 12 are circumferentially spaced apart around the inner surface of the shell 10 and extend in the direction of the axis of rotation of the shell. The spaces between adjacent lifter bars 12 form channels 14 of width J. The length of the bars 12 is shown as LM which is the inner length of the shell in the direction of rotation thereof. Preferably the number of channels 14 is the same as the number of lifter bars 12.

Figure 7:
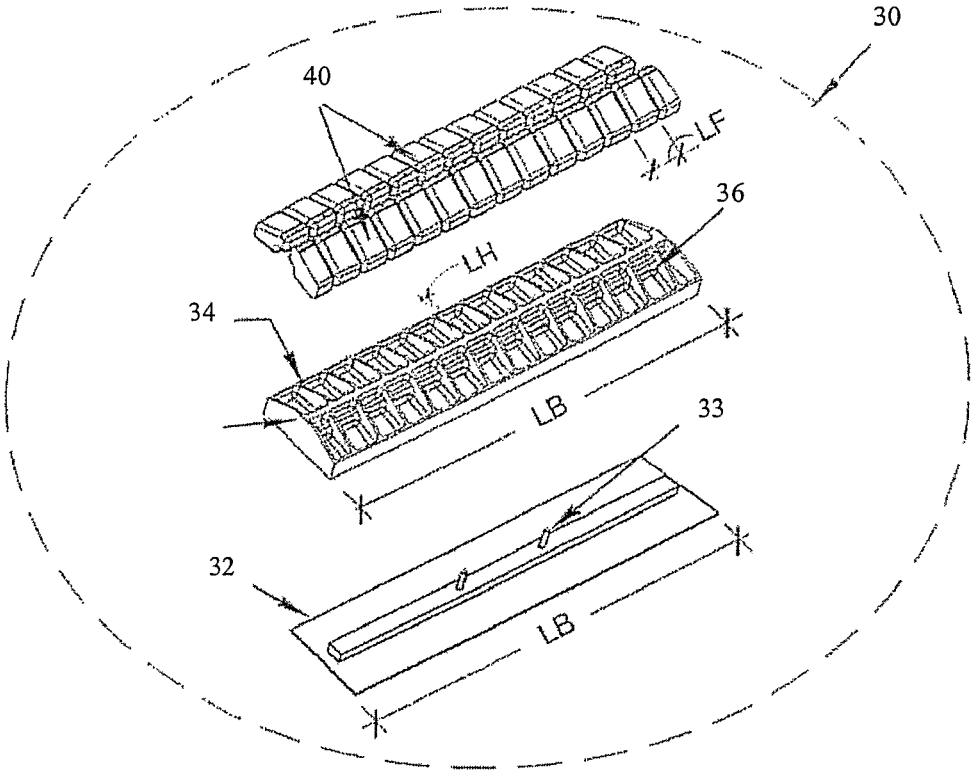
FIG. 7 is a view of the protective liner assembly according to the present invention.

Each channel 14 is adapted to have mounted therein a liner assembly 30 in accordance with the present invention as shown in FIG. 7. The liner assembly 30 includes a base member 32 which is adapted to be mounted to the inner surface of the shell by suitable fastenings such as bolts (not shown). The base member 32 includes an elongated plate having mounting elements 33 thereon.

The liner assembly further includes an elastomeric cushioning member 34 which is secured to the base member 32. The cushioning member 34 has a plurality of cavities 36 therein for receiving wear elements 40. The width of the liner assembly is about the same as the width of the channels 14 between adjacent lifter bars 12 and the length of the liner assembly is between 2 and 12 times the width of the member.

The liner assembly 30 has a base wall having an underside which substantially conforms to the curvature of the inner surface of the shell and side walls extending from the base wall and being of a height K which is approximately the same as the height of the side walls of the lifter bars 14.

Figure 8:
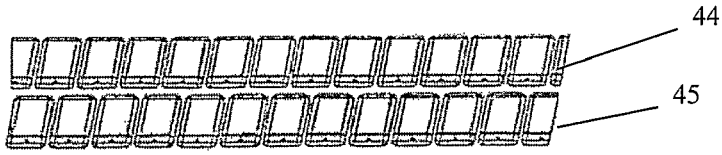
FIG. 8 is a plan view of a preferred form of wear element of the liner assembly of the present invention.
Figure 9:
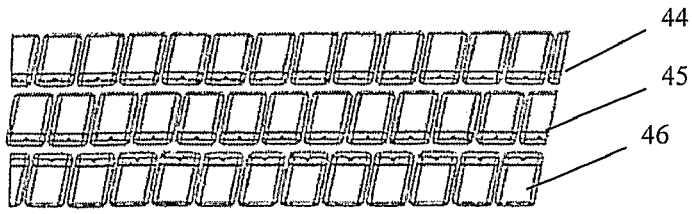
FIG. 9 is a plan view of another preferred form of wear element of the liner assembly of the present invention.
Figure 10:
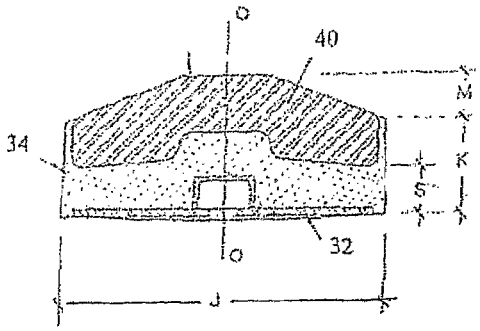
FIGS. 10, 11, 12, 13, 14, 15 and 16 are different configurations of the wear element and the surface exposed to the impact of the apparatus according to the present invention.

As shown in FIG. 8, the wear elements are arranged in two rows 44 and 45 in which the elements are offset from one another. In FIG. 9, three rows 44, 45 and 46 are shown with the elements in adjacent rows being offset from one another.

The wear elements may be formed from metal, a metal alloy, ceramic or any other suitable material. The wear elements preferably have a Brinell hardness between 350 and 800 BHN. The cushioning member may be a natural or synthetic material or a combination of both with a Shore hardness between 30 to 85 hardness Shore A.

Figure 11:
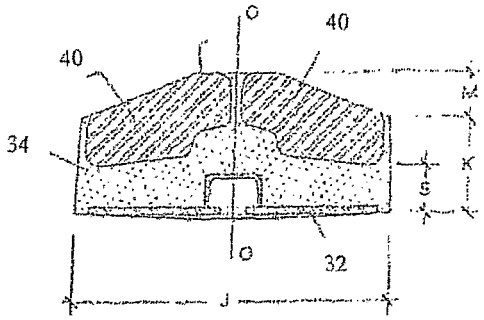
Figure 12:
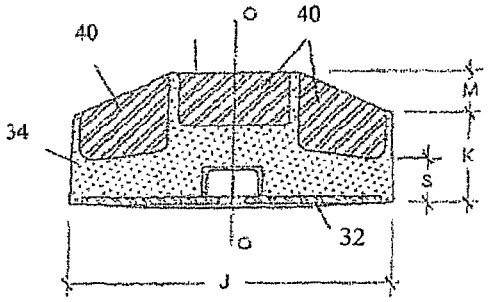
Figure 13:
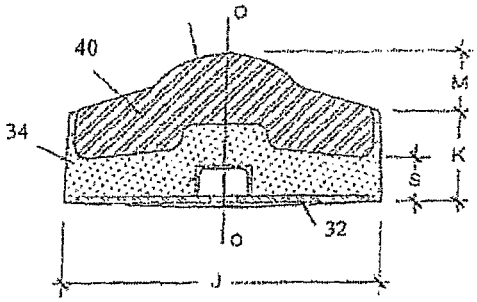
Figure 14:
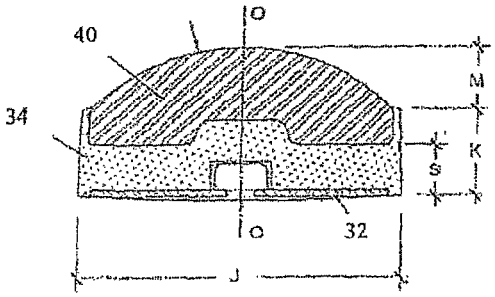
Figure 15:
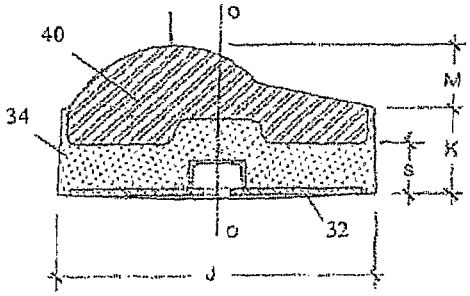
Figure 16:
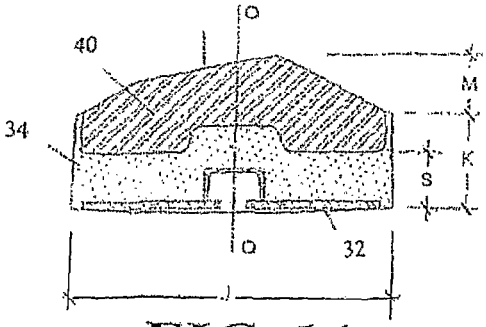

FIGS. 10 to 16 illustrate in cross section various configurations and shapes of the cushioning member and wear elements. FIGS. 10, 13, 14, 15 and 16 show a single row of wear elements 40 of different cross sectional shapes. FIG. 11 illustrates an arrangement with two rows of wear elements 40 and FIG. 12 illustrates three rows of wear elements.

Finally, it is to be understood that the inventive concept in any of its aspects can be incorporated in many different constructions so that the generality of the preceding description is not to be superseded by the particularity of the attached drawings. Various alterations, modifications and/or additions may be incorporated into the various constructions and arrangements of parts without departing from the spirit or ambit of the invention.

The invention claimed is:

1. A grinding mill having a rotatable drum with an inner surface and a liner system positioned on the inner surface of the rotatable drum, the liner system further comprising a plurality of lifter bars extending generally in the same direction as the axis of rotation of the drum and being circumferentially spaced apart around the inner surface of the drum so as to form channels between adjacently spaced lifter bars, and a plurality of liner assemblies, each liner assembly further comprising:

a mounting member for securing the liner assembly to the inner surface of the rotatable drum, the mounting member having a surface for receiving an elastomeric cushioning member;

an elastomeric cushioning member of selected hardness having a base wall operatively connected to the mounting member, opposed side walls, extending a distance K away from the base wall, which terminate at an outer edge, and an outer wall extending between the outer edges of the opposed side walls to define an outermost region of the outer wall, where the outermost region extends away from said base wall a distance which is greater than the distance K;

a plurality of support cavities formed in the outermost region of said outer wall of said elastomeric cushioning member; and a plurality of wear elements having a selected hardness greater than said hardness of said elastomeric cushioning member, each support cavity having one of said wear elements mounted therein to provide wear elements in said outermost region of said outermost wall that are positioned to extend inwardly toward the rotational axis of the rotatable drum, wherein said liner assembly is disposed within respective channels formed between said spaced apart lifter bars, with the mounting members secured to the inner surface of the drum.

2. A liner assembly for use in a grinding mill having a rotatable drum with an inner surface oriented toward a rotational axis about which the rotatable drum rotates, the liner assembly comprising a mounting member which is structured to be operatively secured to the inner surface of the rotatable drum, an elastomeric cushioning member having a base wall operatively connected to the mounting member, opposed side walls extending away from the base wall which terminate at an outer edge and a convex outer wall extending between the outer edge of one side wall to the outer edge of said other side wall and positioned for orientation toward the rotational axis of the rotatable drum, a plurality of support cavities formed in the outer wall of said elastomeric cushioning member, and a plurality of wear elements, each support cavity of said elastomeric cushioning member having one of said wear elements mounted therein, wherein the wear elements have a hardness that is measurably harder than a hardness of said elastomeric cushioning member and the wear elements provide a wear surface substantially over the whole outer wall.

3. A liner assembly for use in a grinding mill having a rotatable drum with an inner surface, the liner assembly, comprising:

a mounting member having a first surface for operative securement to the inner surface of a grinding mill drum and having a second, opposing surface for receiving an elastomeric cushioning member;

an elastomeric cushioning member having a base wall operatively connected to the mounting member and having opposed side walls that each extend a distance K from said base wall to terminate at an outer edge, and an outer wall, extending between said outer edge of one said opposed side wall to said outer edge of the other opposed side wall and extending away from said base wall a distance which is greater than the distance K to thereby define an outermost region of said outer wall;

a plurality of support cavities formed in the outer wall of said elastomeric cushioning member and said outermost region of said elastomeric cushioning member; and a plurality of wear elements, each support cavity of said elastomeric cushioning member having one of said plurality of wear elements positioned therein to provide wear elements that extend beyond the distance K of said opposed side walls, wherein the wear elements have a hardness that is measurably harder than a hardness of said elastomeric cushioning member and the wear elements provide a wear surface substantially over the whole outer wall including said outermost region.

4. The liner assembly according to claim 3 wherein said elastomeric cushioning member is an elongated body and said plurality of support cavities are arranged in one or more rows extending in the direction of the longitudinal axis of the elongated body.

5. The liner assembly according to claim 4 wherein there is provided two or more rows of support cavities arranged side by side.

6. The liner assembly according to claim 5, wherein said plurality of support cavities in one row are offset with respect to the plurality of support cavities in an adjacent row.

7. The liner assembly according to claim 3, wherein the length of the elastomeric cushioning member is between 2 to 12 times the width of the cushioning member.

8. The liner assembly according to claim 3, wherein a distance M measured from said outer edge of each opposed side wall to an outermost region of the outer wall is about 1 to 40 cm.

9. The liner assembly according to claim 3 wherein each support cavity of said plurality of support cavities comprises a lower wall, and the distance S from the base wall of the elastomeric cushioning member to said lower wall of each said support cavity is from 0.1 K to 0.9 K.

10. The liner assembly according to claim 3 wherein the elastomeric cushioning member has a Shore hardness between 30 to 85 hardness Shore A.

11. The liner assembly according to claim 4 wherein adjacent support cavities in a row of said plurality of support cavities are separated by a wall of elastomeric material having a thickness from about 0.5 mm to 20 mm.

12. The liner assembly according to claim 3 wherein said wear elements are generally polyhedric in shape.

13. The liner assembly according to claim 3 wherein the wear elements have a Brinell hardness of between 350 to 800 B.

14. The liner assembly according to claim 3 wherein said opposed side walls are slightly inclined towards one another in a direction from said base wall towards said outer wall.

* * * * *